United States Patent [19]

Kumar et al.

[11] Patent Number: 5,049,789

[45] Date of Patent: Sep. 17, 1991

[54] ELECTRONIC CAPACITIVE BALLAST FOR FLUORESCENT AND OTHER DISCHARGE LAMPS

[75] Inventors: Chitradurga S. P. Kumar, New Delhi; Balasubramanian Ravikrishnan, Benaras, both of India

[73] Assignee: Council of Scientific & Industrial Research, New Delhi, India

[21] Appl. No.: 464,424

[22] Filed: Jan. 12, 1990

[51] Int. Cl.[5] ..... H05B 41/14

[52] U.S. Cl. ..... 315/289; 315/244; 315/DIG. 5

[58] Field of Search ..... 315/298, 209 SC, DIG. 5, 315/244, 209 R

[56] References Cited

U.S. PATENT DOCUMENTS

| | | | |
|---|---|---|---|
| 3,586,817 | 6/1971 | Manz | 315/244 |
| 3,679,936 | 7/1972 | Morekens | 315/DIG. 5 |
| 3,997,814 | 12/1976 | Toho | 315/DIG. 5 |
| 4,342,848 | 8/1982 | Samuels | 315/289 |
| 4,406,976 | 9/1983 | Wisbey | 315/289 |
| 4,443,739 | 4/1984 | Woldring | 315/244 |
| 4,588,925 | 5/1986 | Fahnrich | 315/99 |
| 4,885,507 | 12/1989 | Ham | 315/DIG. 5 |
| 4,929,871 | 5/1990 | Gerfast | 315/244 |

FOREIGN PATENT DOCUMENTS

| | | | |
|---|---|---|---|
| 0018078 | 2/1977 | Japan | 315/289 |
| 0049678 | 4/1977 | Japan | 315/289 |
| 0074773 | 7/1978 | Japan | 315/244 |
| 0098067 | 8/1979 | Japan | 315/289 |

*Primary Examiner*—Eugene R. Laroche
*Assistant Examiner*—A. Zarabian
*Attorney, Agent, or Firm*—Ladas & Parry

[57] ABSTRACT

An electronic capacitive ballast for fluorescent or other discharge lamps is provided which operates at a leading power factor, energy is conserved, lighting is instantaneous and the fluorescent lamps light up even if the filaments are broken. The fluorescent or other discharge lamps comprise of at least once capacitor having normal values upto 20 μF. The capacitor is connected to a power source and at least one inductance coil having values upto 5 H. The inductance coil is connected to a starting device for unidirectional passage of current during starting of the fluorescent lamp. The starting device comprises of Triac, silicon controlled rectifier or the like diode and at least one preset resistor. Two sets of output terminals of the starting device are connected to the fluorescent lamp or other discharge lamps. The starting device is connected to the power source.

1 Claim, 4 Drawing Sheets

ELECTRONIC CAPACITIVE BALLAST FOR FLUORESCENT AND OTHER DISCHARGE LAMPS

The present invention relates to an electronic capacitive ballast for fluorescent and other discharge lamps and particularly useful for starting them.

What is most spectacular about the ballast of the invention is its current limiting feature, leading power factor, minimal power loss by the components used, use of single pin lighting of fluorescent or other discharge lamps and elimination of conventional starters therefor.

After the sudden spurt in prices of crude oil, top priority has been given to conserve energy in almost all the countries of the world. Since it is well known that a unit saved is about 1.5 units generated due to power generation which is not only highly capital intensive but also has a long lead time, modifications on the existing systems have been undertaken to conserve energy. In India along, transmission and distribution loss of energy is nearly 23 percent whereas in the U.S.A. and Japan, it is 11 percent. Reduction of these losses can be achieved by minimizing the loading of transmission and distribution lines. Several devices in the conservation of energy have been developed and these have been successfully used in various fields.

Hitherto, fluorescent or other discharge lamps are started by an inductance coil being connected in series with a fluorescent lamp to the power source and a starter connected across the fluorescent lamp with the starter contacts being initially closed.

The conventional starting system has the following disadvantages:

1. The power loss in the inductance coil is of the order of 25 percent of the input power which is high.
2. The inductance coil is inherently a low lagging power factor device. The whole circuit, therefore, operates at a power factor of 0.5 which is very low as the required power factor is 0.8 to 1.0.
3. Additional capacitor is required to be provided for power factor improvement which increases the cost.
4. If the filament of the fluorescent lamp is broken, the fluorescent lamp will have to be discarded.
5. The sustaining voltage is around 190 volts below which the lamp will not light up.
6. The regulation on fluctuating voltages is poor due to which there will be flickering of the lamp.

The aforesaid conventional starting system has now been modified by the use of a high frequency electronic choke. In this case, although no starters are required, the disadvantages identified below far outweight the few advantages derived or obtained therefrom.

1. The cost is very high.
2. Due to the high frequency chopping, some harmonics may be introduced in the power system as a result of which there is a likelihood of electro-magnetic interference.
3. The sustaining voltage is 180 bolts below which the lamp will not light up.
4. The regulation on fluctuating voltages is poor because of which there could be flickering of the fluorescent lamp.

The electronic capacitive ballast for fluorescent and other discharge lamps according to the invention not only overcomes the aforesaid disadvantages but also improves the system power factor, avoids the use of starter, facilitates single pin lighting to achieve the best results at a cheaper cost. The advantages obtained by the electronic capacitor ballast are as follows:

1. The electronic capacitive ballast operates at a leading power factor.
2. The power consumed by the ballast is of the order of 4 W to 9 W and there is, therefore, energy conservation.
3. The lighting is instantaneous.
4. Even if the filaments of the fluorescent lamps are broken, it is possible to light up such fluorescent lamps.
5. The cost is comparable with the wire wound choke and far less compared with the high frequency electronic choke.
6. The transmission and distribution losses in the power system could be brought down.
7. The use of lumped shunt capacitors on transmission lines could be avoided.
8. Voltage profile of the system is improved.
9. The sustaining voltage of the fluorescent lamp is 120V.
10. The regulation of the fluorescent lamp with fluctuating voltages is better.
11. Electromagnetic interference is negligible.
12. Large scale use of capacitive ballasts would bring down generation during peak burden.
13. Large scale use of capacitive ballast would reduce loading of Transmission and Distribution equipments.

The object of the present invention is to provide such an electronic capacitor ballast for fluorescent or other discharge lamps which overcomes the disadvantages of the prior art systems.

Accordingly, the present invention provides an electronic capacitive ballast for fluorescent or other discharge lamps comprising at least one capacitor having normal values up 20$\mu$ F, said capacitor being connected to a power source and at least one inductance coil having values up to 5 H (Henry), said inductance coil being connected to an input terminal of a starting device for unidirectional passage of current during starting of the fluorescent lamp, and starting device comprising of Triac, silicon controlled rectifier or the like diode and at least one preset resistor, said starting device with two sets of output terminals connecting the fluorescent lamp or other discharge lamps and with a further terminal connectable to said power source.

In order to achieve a value of up to 20$\mu$ F.D. (Microfared) when more than one capacitor is employed of different values, the said capacitors are connected in series-parallel combination.

Similarly, to achieve a value of up to 5 H when more than one inductance coil is employed of different values, the said inductance coils are connected in series-parallel combination.

Preferably, the values of the capacitor may range from 4$\mu$. F.D. to 20$\mu$. F.D. and that of the inductance coil may range from 30 mNH (Multi-Henry) to 2H.

The electronic capacitive ballast of the present invention is illustrated with reference to FIGS. 3 to 9 of the accompanying drawings.

Figure 1:
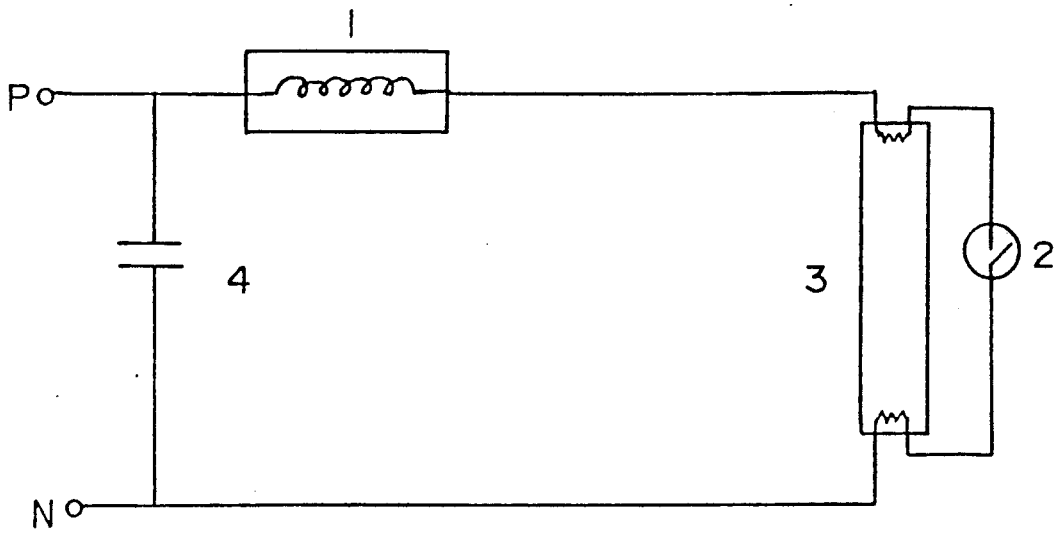
FIG 1 PRIOR ART
FIG. 1 illustrates a prior art circuit in the starting of fluorescent or other discharge lamps using conventional wire would choke.

According to the circuit illustrated in FIG. 1, the inductance coil (1) is connected in series with a fluorescent lamp (3) to the power source (P,N). A starter (2) is connected across the fluorescent lamp (3). The starter (2) contacts are initially closed.

On application of voltage from the power source a current determined by the impedence of the inductance coil flows there through and as a consequence the filaments of the lamp become heated. The starter, because of its basic design opens the circuit after a certain interval of time which causes an inductive voltage kick across the ends of the discharge lamp. Due to the thermionic and field emissions the fluorescent lamp discharges, the lamp is lit up. Since the voltage across the ends of the fluorescent lamp is about 100 volts which is quite insufficient to cause the starter to close, the lamp remains lighted. The inductance limits the current through the fluorescent lamps.

Figure 2:
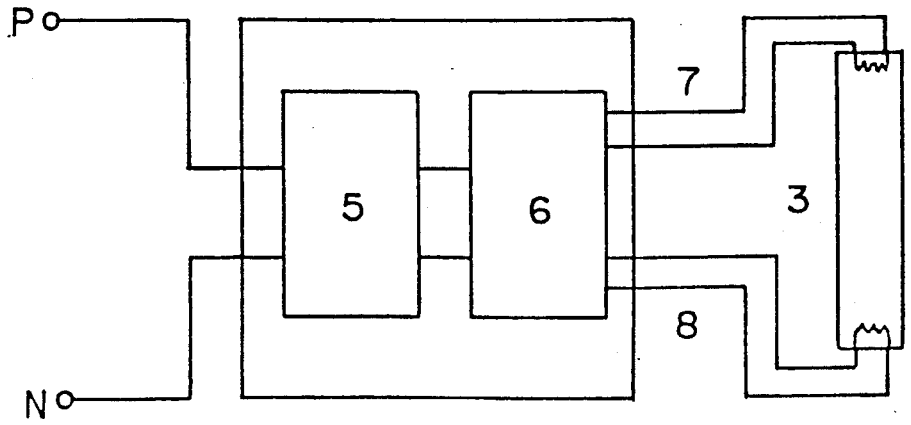
FIG. 2 PRIOR ART
FIG. 2 also shows a prior art circuit diagram in the starting of fluorescent or other discharge lamps using conventional high frequency electronic choke.
Figure 3:
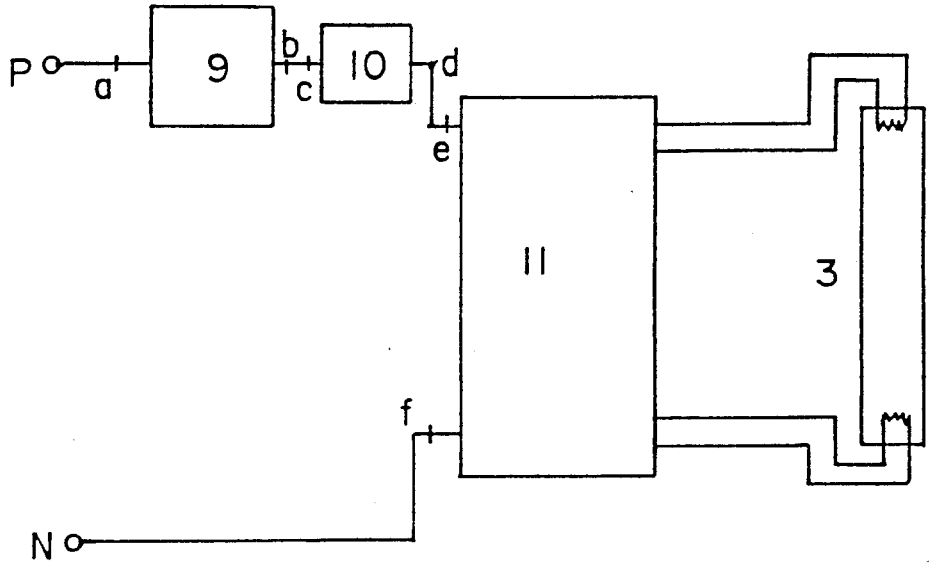
FIG. 3 represents a block diagram of the electronic capacitive ballast.

On the other hand, FIG. 2 illustrates another conventional circuit diagram using a high frequency electronic choke. The system operates as follows:

On connecting the high frequency electronic choke to an A.C. power source (P,N) an A.C. to D.C. converter (5) comprising of diodes, filter circuit etc. converts the A.C. to D.C. The D.C. supply is now chopped in a chopper (6) which consists of triacs or SCR'S, transistors, resistors, capacitors etc. The high frequency chopped D.C. 10 to 20 K Hz is stabilised through a small inductance coil (not shown in Figure) and is available at two pairs of terminals 7 and 8 which are connected to the two ends of the lamp. A typical voltage available at these terminal pairs is 75 volts.

An embodiment of the electronic capacitive ballast according to the invention and its operation will now be described with reference to FIGS. 3-9 of the drawings.

Terminals (P,N) are connected to an A.C. power source. Terminal (a) of the capacitor (9) is connected to terminal (P) of a Power source whereas the terminal (b) of the capacitor (9) is connected to terminal (c) of an inductance (10), the other terminal (d) of the inductance (10) is connected to the input terminal (e) of the starting device (11). The terminal (f) of the starting device (10) is connected to the other terminal (N) of the power source.

Figure 4:
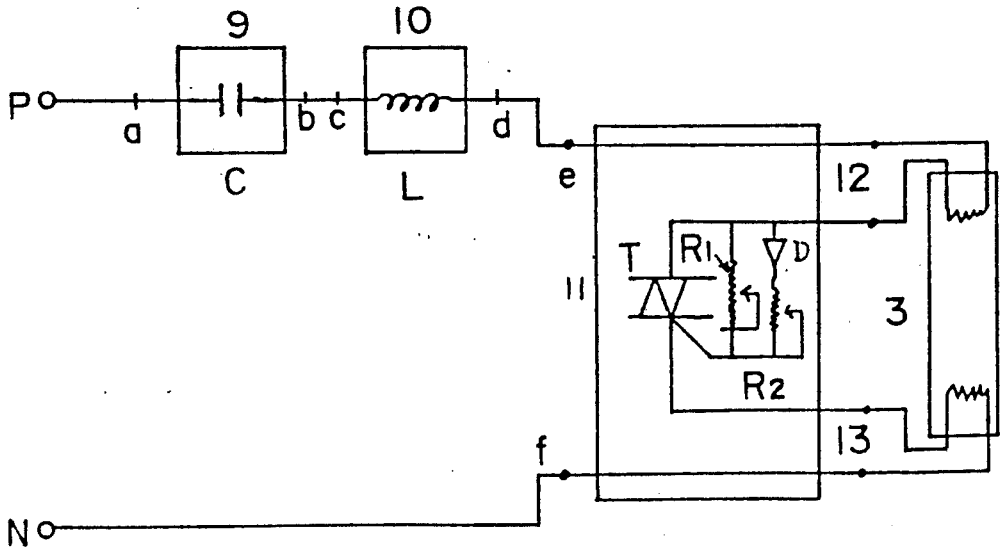
FIG. 4 illustrates a circuit diagram of the ballast using a triac, diode, two preset resistors.
Figure 5:
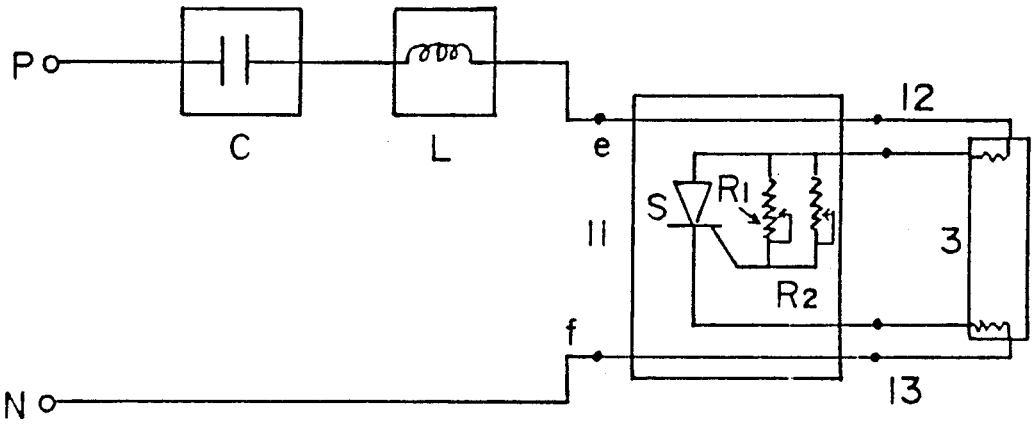
FIG. 5 shows a circuit diagram of the ballast using an SCR and preset resistors.
Figure 6:
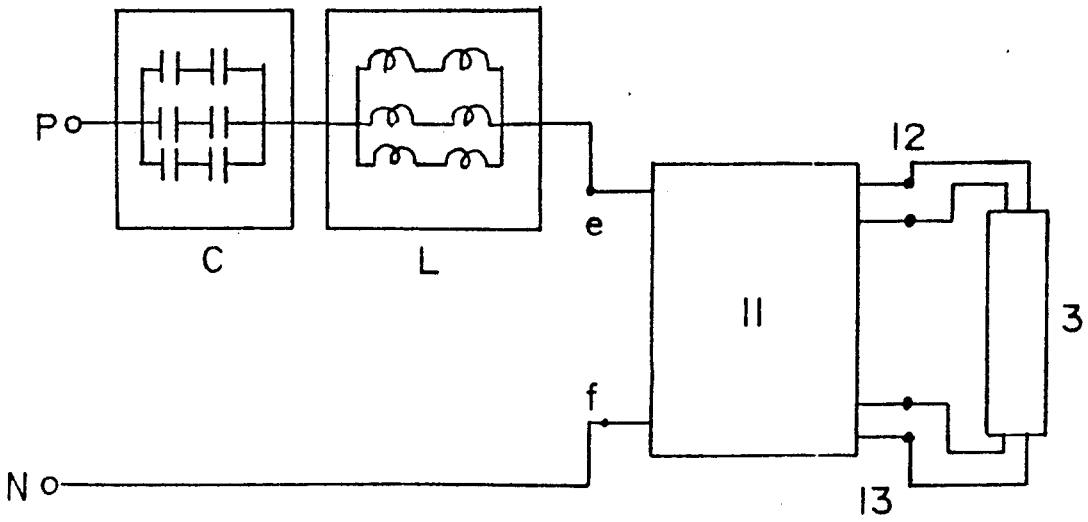
FIG. 6 shows a block diagram of the ballast using a series-parallel combination of capacitors and inductance coils.
Figure 7:
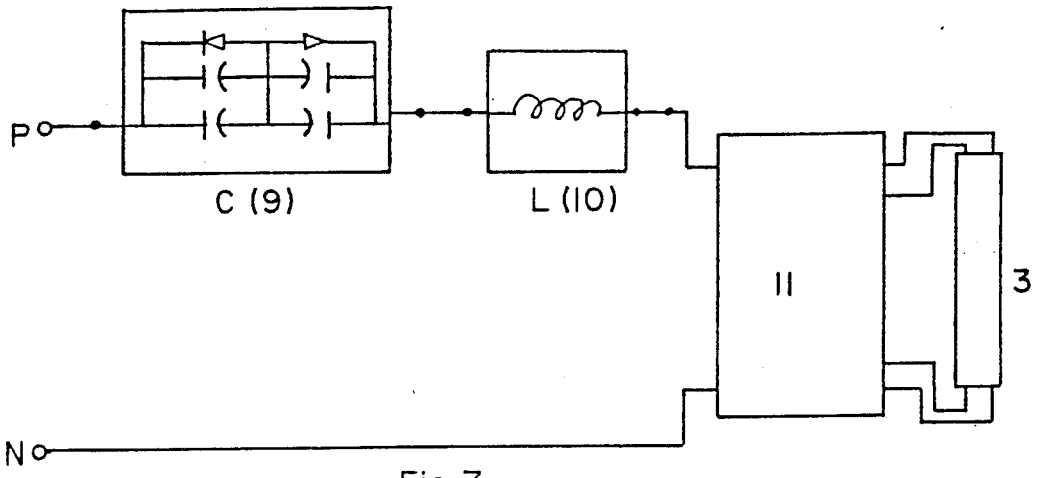
FIG. 7 shows a block diagram of the ballast using a series-parallel combination of electrolytic capacitors and accompanying diodes.
Figure 8:
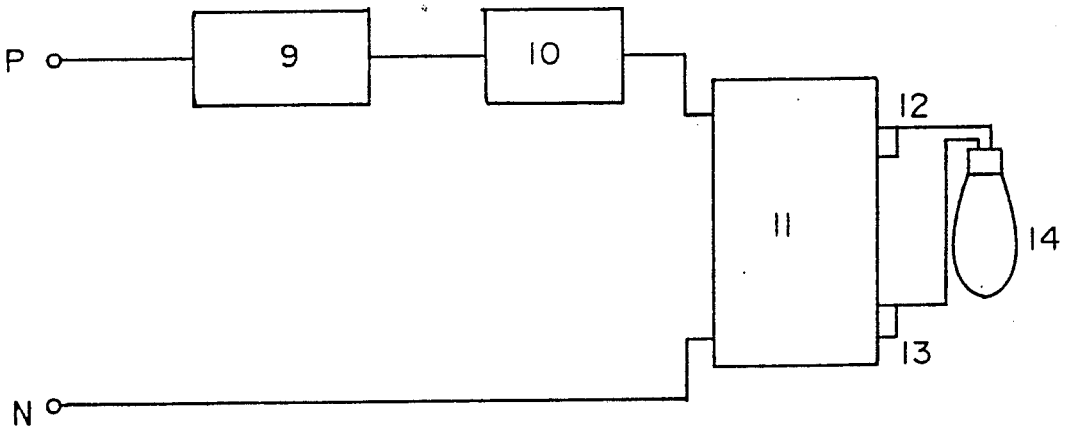
FIG. 8 shows a block diagram of the ballast for a mercury vapour lamp.
Figure 9:
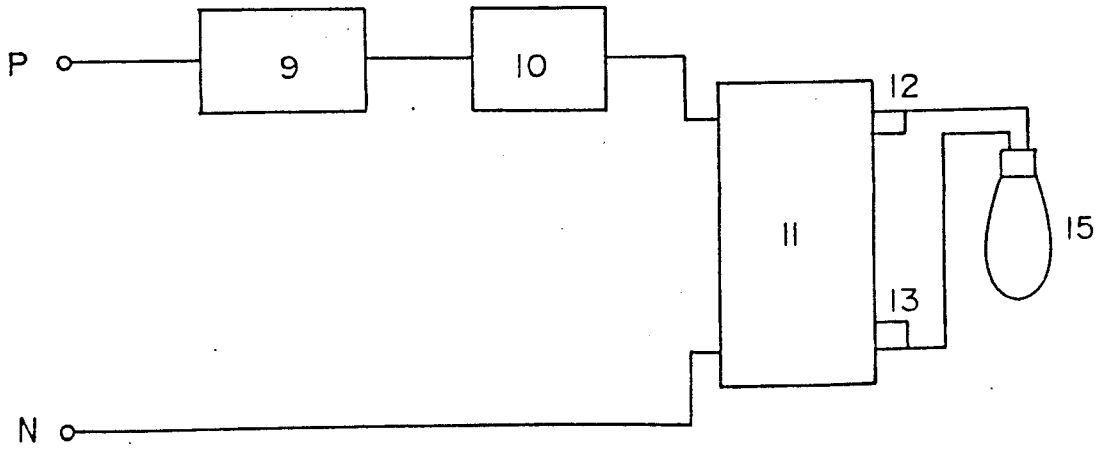
FIG. 9 shows a block diagram of the ballast for a sodium vapour lamp.

The two pins or terminals (12) of the starting device are connected to the flourescent lamp (3). The circuit diagram of the operation is shown in FIG. 4 C is a single capacitor or a bank of capacitors. L is a small stabilizing inductance coil or a plurality of inductance coils. T is triac, D is a diode, R-1, R-2 are presets. During the positive ½ cycle of the AC wave, R-2 fires the Triac to provide the charging current through the capacitor. The capacitor C will get charged to the peak voltage of the AC wave namely 2 ×VRMS (Voltage Route Means Square). During the positive ½ cycle, the circuit also causes the filaments of the fluorescent lamp to get heated. During the negative ½ cycle, the Triac is not fired.

So the negative peak voltage plus capacitor voltage is available across the fluorescent lamp. This is ample to cause conduction in the fluorescent lamp. If during the first cycle the fluorescent lamp is not lit up, the circuit causes the current to flow through, thus heating the fluorescent lamp further. The process is repeated in the subsequent cycles, finally lighting the lamp. Now the voltage across the fluorescent lamp is 80 to 100 volts. As the presets R-1 and R-2 are adjusted to fire the triac at/near the peak of the AC cycle the voltage of 80 to 100 available will not be sufficient to fire the triac. The current limiting is done by the capacitor C. The small inductance (L) acts to stabilize the current.

Preferred values of the components in the ballast of the present invention are given below:

Capacitance—4 to 20 MFD
Inductance—20 mH to 2 H.
Diode—1m Amps to 2 Amps.
Preset resistors—10 K to 220 K
Fluorescent lamp—20 W, 40 W, 80 W.
Other Discharge lamps—Mercury vapour, sodium vapour The invention is illustrated with the following example which should not be construed to limit the scope of the invention.

EXAMPLE

An experiment was conducted in the laboratory to determine the performance of the capacitive ballast. The results are tabulated below:

Vin—Input voltage
C—Capacitor
L—Inductor
P.f.—Power Factor (Leading)
I—Current in the system
$V^{tube}$—Voltage across the tube
Pin—Power input
Ptube—Power Across the tube

INFERENCE

1. The power factor is always leading.
2. The loss in the ballast Col-6 Col-7 varies from 4W to 9W for various designs.
3. The current varies from 0.33 to 0.75 for various designs.

THE EXPERIMENTAL DATA IS TABULATED BELOW
Fluorescent Lamp: 40 W

| S.L. | 1 Vin | 2 C MFD | 3 L mh | 4 I | 5 V Tube | 6 Pin | 7 P tube | 8 Pf |
|---|---|---|---|---|---|---|---|---|
| 1. | 230 | 10 | 120 | 0.66 | 67 | 54 | 45 | 0.72 |
| 2. | 250 | 6 | 120 | 0.43 | 94.0 | 49 | 44 | 0.90 |
| 3. | 212 | 5 | 100 | 0.36 | 92.6 | 47 | 42 | 0.61 |
| 4. | 212 | 4.7 | 50 | 0.33 | 110 | 47 | 40 | 0.67 |
| 5. | 223 | 8 | 70 | 0.55 | 69 | 52 | 46 | 0.42 |
| 6. | 230 | 9 | 70 | 0.65 | 61 | 50 | 40 | 0.33 |
| 7. | 230 | 10 | 50 | .69 | 61 | 53 | 44 | 0.31 |
| 8. | 230 | 11 | 50 | .75 | 80 | 56 | 47 | 0.32 |

From the above, it is seen that the capacitive ballast has many advantages.

We claim:

1. A combination of an electronic capacitive ballast and starting device for a fluorescent lamp comprising a leading power factor L-C combination comprising an inductance element and a capacitance element connected in series, said L-C combination including an input terminal and an output terminal, said capacitance element having a value up to 11 $\mu$F and said inductance element having a value ranging from 50 mH to 1 H, said input terminal being adapted to be connected to one of two terminals of a power source, and a starting device having first and second input terminals, the output terminal of said L-C combination being adapted to be connected to said first input terminal of said starting device through one filament of a fluorescent lamp, said starting device comprising a triac (T) having first and second main terminals and a gate terminal, a gate circuit, said gate circuit being connected across said first main terminal and said gate terminal of said triac (T) and comprising a first variable resistor ($R_1$) connected in parallel with a diode (D) in series with a second variable resistor $R_2$, the second input terminal of said starting device being adapted to be connected to the other of the two terminals of the power source by means of an zero impedance connection to a second filament of the fluorescent lamp.

* * * * *